US008646876B2

(12) United States Patent
Kozee et al.

(10) Patent No.: US 8,646,876 B2
(45) Date of Patent: Feb. 11, 2014

(54) STREAM PRINTING METHOD

(75) Inventors: Michael Kozee, Wheaton, IL (US); John P. Folkers, Palatine, IL (US); Kevin W. Kuester, Freeburg, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 13/376,227

(22) PCT Filed: Jun. 7, 2010

(86) PCT No.: PCT/US2010/037588

§ 371 (c)(1),
(2), (4) Date: Dec. 5, 2011

(87) PCT Pub. No.: WO2010/144343

PCT Pub. Date: Dec. 16, 2010

(65) Prior Publication Data

US 2012/0075385 A1 Mar. 29, 2012

Related U.S. Application Data

(60) Provisional application No. 61/185,465, filed on Jun. 9, 2009.

(51) Int. Cl.
*B41J 2/14* (2006.01)

(52) U.S. Cl.
USPC ..... 347/47

(58) Field of Classification Search
CPC ..... B41J 3/407; B41J 2/02; B41J 2/03; B41J 2/025; B41J 2/035; H05K 3/1241; H05K 3/125; C09D 11/30; B29C 67/0059
USPC ..... 347/47
See application file for complete search history.

(56) References Cited

U.S. PATENT DOCUMENTS

| | | | | |
|---|---|---|---|---|
| 5,491,499 | A * | 2/1996 | Bibbe et al. | 347/47 |
| 7,331,654 | B2 * | 2/2008 | Horsnell et al. | 347/54 |
| 7,485,345 | B2 | 2/2009 | Renn et al. | |
| 7,604,333 | B2 * | 10/2009 | Horsnell et al. | 347/85 |
| 2005/0015175 | A1 | 1/2005 | Huang | |
| 2007/0169806 | A1 * | 7/2007 | Fork et al. | 136/256 |
| 2008/0138999 | A1 | 6/2008 | Eldershaw | |
| 2008/0145633 | A1 * | 6/2008 | Kodas et al. | 428/220 |
| 2009/0061077 | A1 | 3/2009 | King et al. | |
| 2010/0295900 | A1 * | 11/2010 | Weir | 347/47 |

OTHER PUBLICATIONS

Author Unknown, "Planning and Installing Photovoltaic Systems: A guide for installers, architects and engineers," Deutsche Gesellschaft Für Sonnenenergie (Dgs); Routledge; 2nd edition (Dec. 18, 2007). USA.

Author Unknown, "Aerosol Jet Solar Print Engine," date unknown, downloaded from www.optomec.com.

(Continued)

*Primary Examiner* — Alessandro Amari
*Assistant Examiner* — Michael Konczal
(74) *Attorney, Agent, or Firm* — Joseph A. Yosick

(57) ABSTRACT

A printing method includes providing a print head. The print head includes a valve and at least one orifice. Fluid is ejected from the orifice in a generally continuous stream. The fluid includes a conductive material. The fluid is deposited in a pattern on a substrate to form an electrically conductive deposit. At least a portion of the pattern includes a generally straight line.

17 Claims, 5 Drawing Sheets

(56) References Cited

OTHER PUBLICATIONS

Christopher Wargo, "Characterization of Conductors for Printed Electronics", date unknown, downloaded from www.nanopchem.com.

Author Unknown, "Schmid's new DoD2000 ink-jet printer increases throughput," date unknown, downloaded from www.schmid-group.com.

* cited by examiner

STREAM PRINTING METHOD

RELATED APPLICATIONS

This application claims priority under 35 U.S.C. §371 from PCT Application No. PCT/US2010/037588, filed in English on Jun. 7, 2010, which claims the benefit of U.S. Provisional Application No. 61/185,465, filed Jun. 9, 2009, the disclosures of both of which are incorporated herein by reference in their entireties.

BACKGROUND

The present disclosure relates to a method of applying a conductive material through the use of a printer with a generally continuous fluid stream.

Screen-printing is a commonly used technique for the front side metallization of crystalline silicon solar cells. However, screen printing is reaching technical limitations as manufacturers seek to produce higher efficiency cells and reduce production costs. For example, contact printing methods do not allow photovoltaic suppliers to minimize the silicon used to fabricate cells due to the propensity for increased wafer breakage and scrap. Optional non-contact printing methods for applying contacts to solar cells typically use droplets of fluids containing a conductive material. Inkjet printing is a common method of forming drops; however, inkjet printing can not reliably apply enough conductive material per unit time to sustain state-of-the-art production rates. Also, conductive contacts formed from discrete droplets can result in relatively rough printed edges, thus reducing the contact current conducting capability relative to trace applied by a continuously-discharging applicator. One manner of increasing contact quality and reducing linewidth is to use very small drops by aerosolized drop generation, but these systems are also limited by throughput and reliability. Another means is to use microsyringe extrusion applicators, but these are also limited by overall throughput as well.

BRIEF SUMMARY

The present disclosure provides a printing method for depositing a conductive material on a substrate.

In one aspect, a printing method includes providing a print head. The print head includes a valve and at least one orifice. Fluid is ejected from the orifice in a generally continuous stream. The fluid includes a conductive material. The fluid is deposited in a pattern on a substrate to form an electrically conductive deposit. At least a portion of the pattern includes a generally straight line.

In another aspect, a printing system includes a print head assembly, a fluid supply, and a control mechanism. The print head assembly includes a plurality of individually-addressable modular print heads. Each modular print head includes an orifice with a diameter of less than 100 microns. The fluid includes a conductive material. The control mechanism controls the flow of fluid from the orifices. The print head is capable of ejecting a fluid from the orifice in a generally continuous stream and depositing the fluid in a pattern on a substrate to form an electrically conductive deposit.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
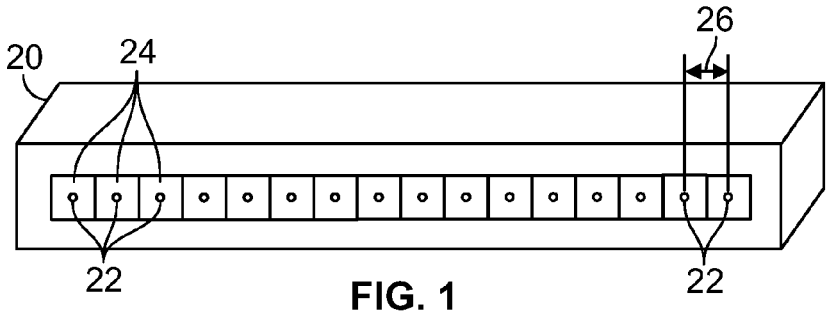
FIG. 1 is schematic view of an embodiment of a print head assembly.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a method for printing contacts on a substrate with a generally continuous stream of fluid containing a conductive material. The fluid physical properties requirements for the currently described method are less restrictive than those for a typical inkjet print head, and the conceivable range of jettable fluid conductive material loading is wider with the present method. For example, while printing a given printed trace across a photovoltaic wafer, the method might require only two valve-motion events—one open (on) and one closed (off). In contrast the inkjet method depends on thousands of drop fire events per trace. The ejection of fluid is further dependent on the formation of a stable meniscus at the nozzle orifice and specialized fluids are required to meet the fluids dynamics criteria for proper drop breakoff. As the pigment loadings increase, these problems generally give rise to poor printing reliability. Furthermore, meeting these requirements at the required print loading for inkjet printing contacts has not been accomplished in practice.

The increased fluid conductive content possible with the present method enables better conductivity of the printed lines in a single printing pass than typical inkjet. The method furthermore provides contacts of acceptable width as well as superior smoothness, resulting in desirable electrical resistance properties. The ability to print contacts with desired widths combined with the opportunity to reduce resistance gives the continuous printing method a significant advantage over conventional printing techniques in the goal of improving improve solar cell efficiency.

The present printing method provides other advantages in manufacturing. For example, the continuous printing method is a non-contact method and as such, no pressure is placed on the relatively fragile wafers. This is in contrast to conventionally employed screen-printing in which the screen is forced into contact with the wafer as the squeegee forces paste through the openings in the screen. The latter method routinely results in wafer breakage. Production efficiency is negatively impacted by the loss of wafer material and line downtime associated with cleaning the broken wafer material out of the printing station. While not directly affecting optoelectronic cell efficiency, line downtime lowers profitability of a cell manufacturing line.

Hence, the present non-contact printing method will enable the use of thinner silicon wafers which will provide added cost savings. Current wafers are produced with a thickness (on average) of 190 microns. Sub 100 micron wafers are theoretically possible, depending on the grain size of the silicon crystals. The industry would also prefer to produce wafers with thinner profiles to reduce production costs and solar cell panel weight.

Figure 2:
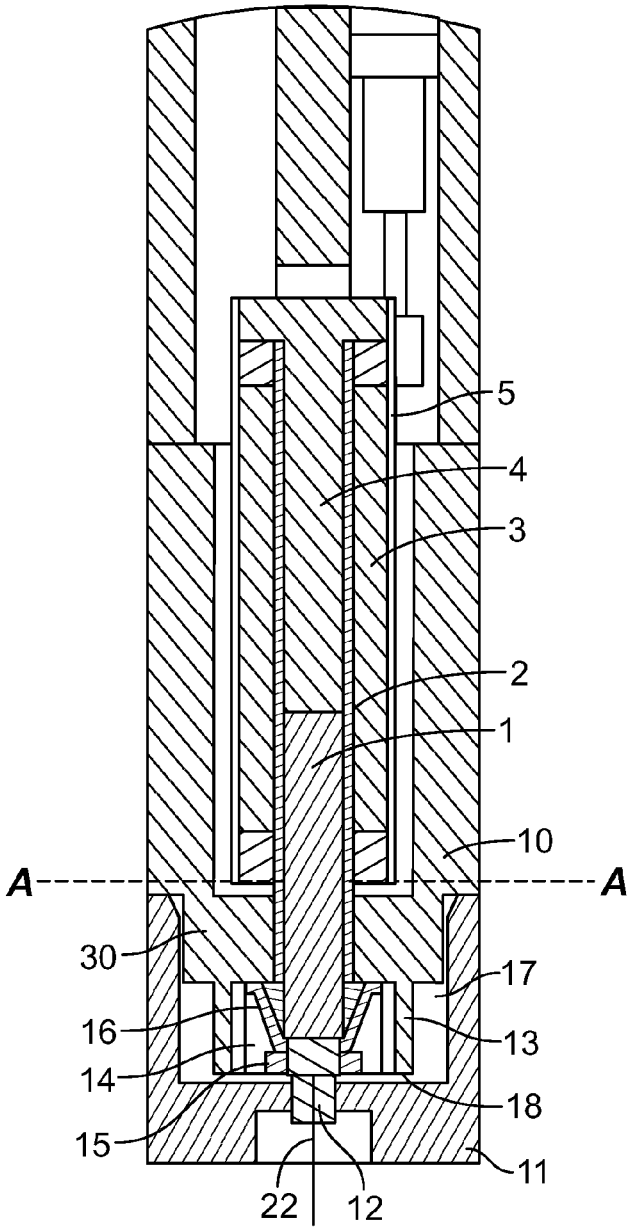
FIG. 2 (PRIOR ART)
FIG. 2 is a cross sectional view of an embodiment of a prior art print head.

The printing method disclosed herein uses a print head to apply fluid to a substrate. An embodiment of a print head assembly 20 is shown in FIG. 1. The print head 20 includes a valve (an example of which is shown in FIG. 2) and at least one orifice 22, although a plurality of orifices 22 is typically used. The orifices 22 may be disposed in a linear fashion, as illustrated in FIG. 1. Other arrangements of orifices 22 are also possible, such as staggered or diagonal. Each orifice 22 may be duplicated in a serial manner within a mounting structure and thus the number of orifices may be sixteen as depicted in FIG. 1, or any other conceivable number, limited by the individual valve dimensions. This plurality of orifices is disposed in a structure commonly referred to as a print head.

The spacing between adjacent orifices 22, or pitch distance, may be equal to or an integer multiple of the desired collector line spacing. The pitch distance 26 between adjacent orifices 22 is preferably less than or equal to 10 mm. The pitch distance 26 may be less than or equal to 8 mm, 5 mm, 4 mm, or 2 mm. The resulting single pass pitch distances on the wafer can be increased by using multiple print head assemblies 20. For example, a simple staggered arrangement of two print head assemblies 20 is possible where orifices from a second head are located one half the distance between orifices on the first head. This arrangement will provide the ability to print lines with a pitch of 1 mm. Multiple print heads can also be ganged this way in a staggered arrangement yielding any desirable pitch down to better than 0.03 mm.

A fluid is ejected from the orifice 22 in a generally continuous stream. The fluid includes a conductive material. The fluid flow is preferably controlled by a valve mechanism, a specific embodiment of which is further described below and depicted in FIG. 2. The valve is preferably electromechanically switchable between the open/on and closed/off state. The print head assembly 20 may include a single valve for all the orifices 22, or each orifice 22 may be separately controlled with its own valve. Valves may be electromechanically electromagnetically or pneumatically actuated. The sealing mechanism may be of any conventional design, including screw, plunger or flapper-based mechanisms.

Turning now to the size and configuration of the orifice 22, the orifice 22 of the print head preferably has a diameter of less than 100 microns. In certain embodiments, the orifice 22 has a diameter of less than or equal to 70 microns, 45 microns, or 25 microns. The linewidths of the conductive material deposited by the present printing method are largely a function of the orifice, as the continuous streams have a nominal width about the same as the orifice diameter. Unlike discrete drops applied by other non-contact methods which spread in air due to the surface tension of the fluid, the streams of the present method do not spread substantially in flight until the stream impacts the substrate surface.

The orifice 22 preferably exhibits an aspect ratio between 0.5 and 8. The aspect ratio is defined as the depth of the bore divided by the diameter of the orifice. The aspect ratio is more preferably between 0.5 and 4.0. The desired bore depth may be implemented in a variety of ways; i.e., it might be controlled by the thickness of a metallic orifice plate or by the inherent depth of a ruby or ceramic orifice material. Higher aspect ratios generally provide for increased jet straightness at the expense of increased flow resistance. In addition, conventional droplet printing is highly dependent on the orifice quality and in particular the exit edge quality of the jetting hole. The continuous stream of the present printing method will be capable of printing the continuous lines with a less costly nozzle hole.

The print head assembly 20 and associated components may be controlled by any suitable control mechanism, such as a conventional PC or digital or analog control mechanisms integrated directly into the printer.

Figure 3:
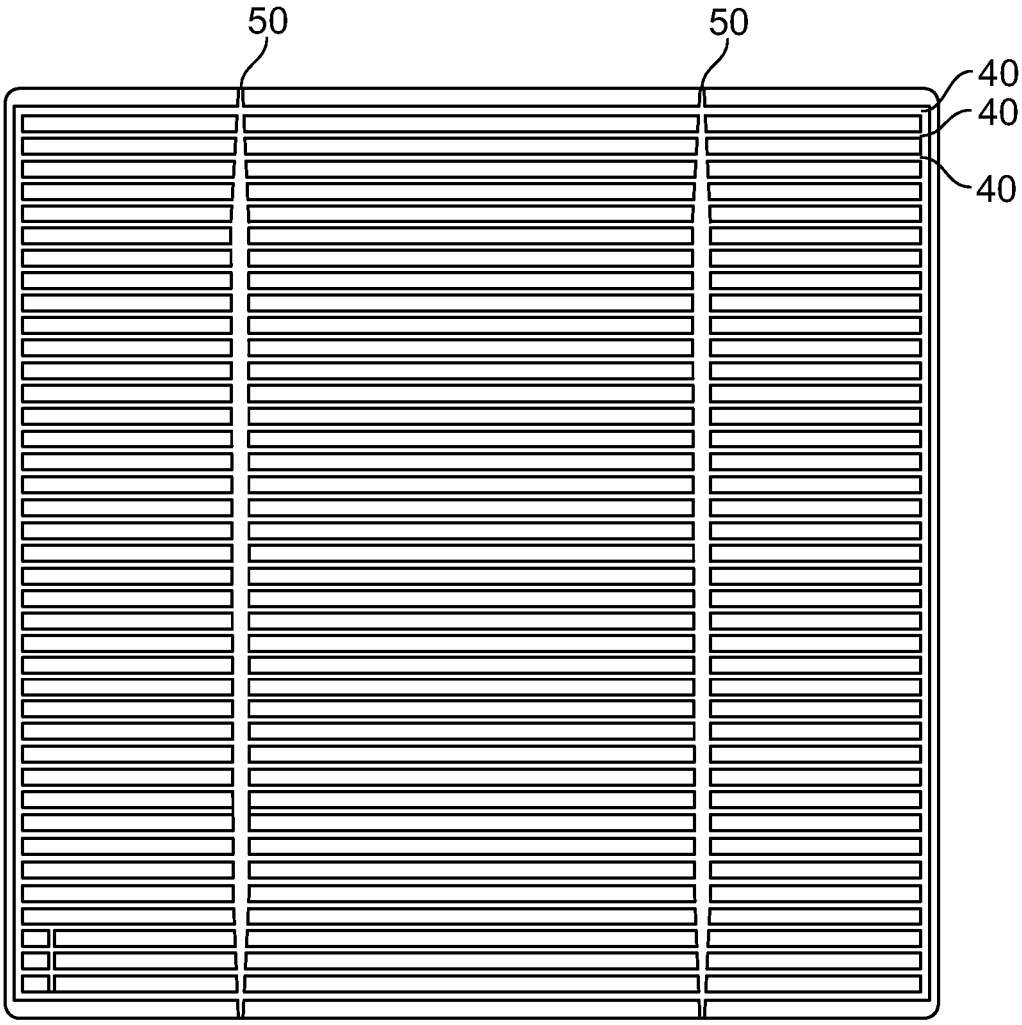
FIG. 3 (PRIOR ART)
FIG. 3 is schematic view of a conventional photovoltaic device.

The fluid is deposited in a pattern on a substrate to form an electrically conductive deposit. At least a portion of the pattern includes a generally straight line. The printing method is capable of printing a vector compatible pattern. Conventional solar cells, an example of which is shown in FIG. 3, are fabricated with a series of front-side metallized conductive contacts that includes many narrow collector lines 40 (typically between 100 and 150 microns wide) and several orthogonal busbars 50 with a larger width (typically 2 mm wide). A typical 156 mm by 156 mm solar wafer consists of between 60 and 80 collector lines and two or three busbars. The scalability of the nozzle pitch as described above enables this method to be used for printing without a loss in overall throughput of both the narrower collector lines and of the wider busbars. For example, in such a system, two different assemblies of nozzles would be provided. In the first assembly, nozzles with an pitch equal to that of the collector lines would deposit singular traces. In a secondary step, the busbars would be deposited by a second nozzle assembly arranged with a pitch corresponding to the busbar pitch and also using multiple staggered nozzles at increased nozzle pitch in order to cover the 2 mm width of each of the busbars. This secondary step would preferably occur in-line with the first step either before or after drying and/or sintering the conductive lines in the first step. It would be desirable that the wafers be turned in the second process so that the busbars could be applied parallel to the production line motion. However, the print heads could be mounted on a traversing arm and the traces could generally be applied orthogonal to the production motion.

The collector line applied to the substrate preferably has a width less than or equal to 200 microns. More preferably, the line applied to the substrate has a width less than or equal to 100 microns, less than or equal to 60 microns, or less than or equal to 40 microns. The collector line generally has a height (or thickness) requirement that is dependant on the linewidth (i.e., since conductivity is the product of the line cross-sectional area) and is preferably at least 3 microns; at least 10 microns; or at least 20 microns.

Figure 8A:
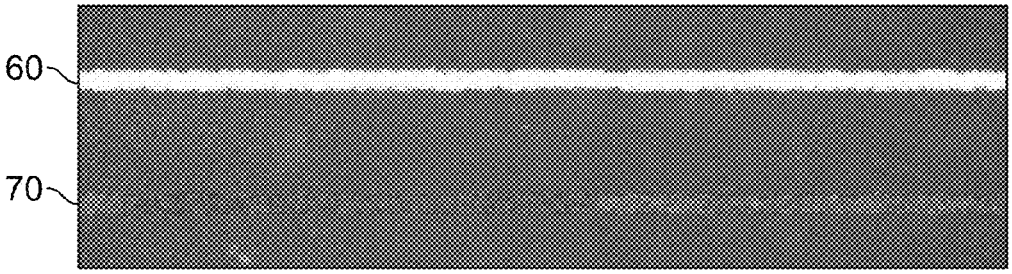
FIG. 8*a* shows a conventional screen printed silver line on a photovoltaic wafer compared with a line printed by an inventive method.

The present printing method uses a continuous stream of fluid to deposit the conductive material, which results in contacts with exceptional smoothness. The line preferably has a sheet resistance maximum value of less than 10 mOhms per square cm, preferably less than 5 mOhms per square cm, and most preferably less than 2 mOhms per square cm. The deposited lines are substantially straight due to the nature of the continuous streams as shown in FIG. 8*a* which shows a conventional screen printed silver line 60 on a photovoltaic wafer compared with a line 70 printed by this method.

Figure 8B:
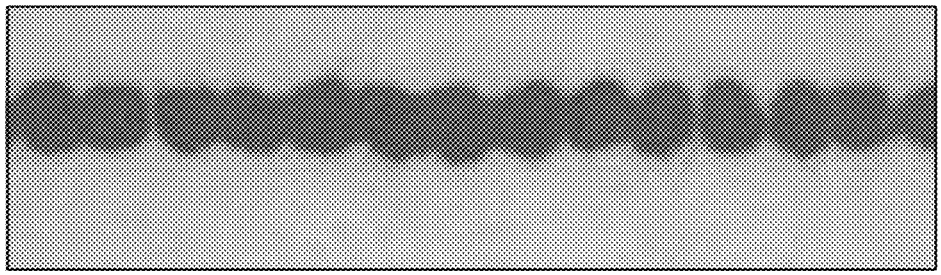
FIG. 8B (PRIOR ART)
FIG. 8*b* shows a line printed with a conventional piezo printer.
Figure 8C:
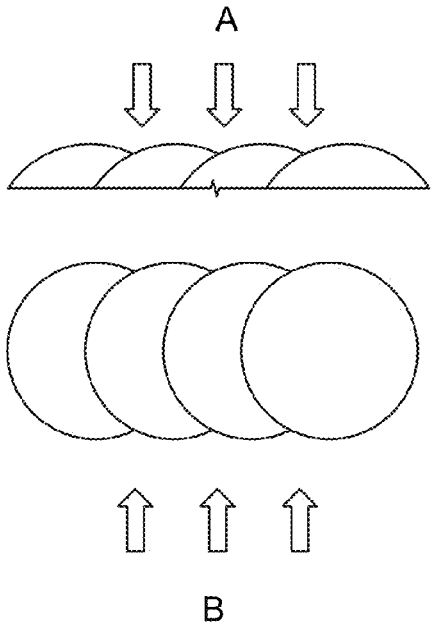
FIG. 8C (PRIOR ART)
FIG. 8*c* is a schematic view of a line printed with a conventional piezo printer.

In comparison, conventional large drop piezo inkjet—i.e., delivering 80 pL drop sizes—would print lines as a series of overlapping, contiguous dots as is shown in FIG. 8*b* which depicts actual output from a piezo print engine. The overlapping dots result in a rough or scalloped edge, represented in FIG. 8*c* by A and B. The regions as denoted act essentially as nodes of electrical resistance—i.e., the current throughput is limited by the actual surface contact between the dots which is non-optimal at the node regions.

In addition, drop placement errors contribute to electrical defects in the lines. The action of the piezo pumping force on the fluid at the orifice meniscus is inherently a random physical perturbation, as is the physical release of the drop from the orifice surface. Hence, the printed drop trajectories will lie within a conical region about the closest linear path to the substrate from the orifice center and the radial position of the drop along this conical surface will be random. This random distribution may lead to drop placement errors under normal circumstances with well-defined fluids that are up to 10% of the desired linewidth.

The printed traces as described herein are also substantially free from drop related print defects such as splatter and drop tailing, two phenomena well known in the art. Hence, sustained fluid deposition rates can be varied without degradation in quality as would not be possible using typical DOD inkjet devices at different drive frequencies. Splatter particularly occurs in large-drop inkjet devices where drops are not dried completely and subsequent overlapping or semi-overlapping drops are printed on top.

The available single-pass line speeds of the print head 24 (or print head assembly 20) with respect to the substrate is significantly faster than conventional non-contact techniques and potentially faster than screen printing. The fluid stream for a single orifice has a deposition rate of at least 1.5 mg/s. Preferably, the deposition rate is greater than or equal to 2 mg/s, 5 mg/s, 8 mg/s, or 10 mg/s. A constant rate of about 1.5 mg/s at a fluid density of 1.5 g/cc is generally required to achieve laminar flow through a cylindrical orifice presuming that the orifice is of sufficient smoothness and uniformity.

The line speed at the above described sustained flow rates will translate into single-print head linear speeds that are preferably at least 50 mm/s, more preferably at least 100 mm/s, and most preferably at least 200 mm/s. For a specific example where 1.5 mg/s of silver ink is deposited, the effective linear throughput of 6 inch wafers would be at least about 370 wafers/hour. The calculated values presumes a trace profile of 100 microns by 15 microns height, a conductive metal weight percentage in the ink of 20% and a constant bulk cured trace density of 8 grams/cm$^3$. This net production rate is approaching that of standard screen printers. Based on the measured deposition rates for this method as shown in the examples, this is a conservative potential and the actual throughput using this photovoltaic construction method would be higher, depending on the required conductivity and linewidth for a given photovoltaic wafer. Of course, the rate may be increased by using more than a single print head in-line as required. Rates could also be increased by using fluids with increased silver content. Fluids with silver weight percentages of more than 70% are feasible.

The ability of non-contact methods to print at high rates in a single pass with very narrow pitch distances (<1 mm) is unique to stream printing. The print heads as described herein are more cost effective than inkjet printers as they can be designed with only the minimum number of required orifices to print the required number of traces on the cell surface. The best-available large-drop conventional inkjet print heads cannot meet the deposition rates required by current solar cell processes. For example, a industrially common piezo print head Galaxy or Nova series operating at a typical frequency (ca. 10 kHz) delivering 80 picoliter drops would only deposit fluid at a rate of about 1.2 mg/s per nozzle under steady state conditions. Using the same presumptions as above for ink loading, cured trace density and trace dimensions, the total throughput would be about 294 wafers/hour or less than half the minimum rate achievable by the current method.

Smaller drop volume inkjet heads can theoretically deliver sufficient fluid volumes for high single-pass throughput. For examples, a print head delivering drops on the order of 20 mL would need to operate at a sustained print rate of 40 kHz to deliver 1.5 mg/s. Operating at half that frequency, which would be more feasible, heads would be required to scan over the same line positions for multiple iterations to build up the line. Inkjet nozzles being typically disposed in a monolithic linear array are not easily optimized for this purpose.

Aerosol type printers (as described in U.S. Patent 20090061077) are inherently limited with respect to fluid deposition rate due to very small drops—only tens of femtoliters in size. In comparison to the present invention, systems commercially available from Optomec only deliver on the order of 0.5 mg/s per nozzle. They are further limited in their ability to work in single pass, narrow pitch applications in that the aerosolized drops are guided to the substrate by gaseous sheaths. As nozzle pitch is decreased, the gaseous sheath from one nozzle ultimately interacts with aerosolized drops emitted from neighboring nozzles. Hence, it will be inherently difficult using this technology to design a system that can simultaneously print lines in close proximity.

High pressure dispensing type printers, such as those available from nScrypt Corporation as disclosed in U.S. Patent Application 20100055299 can also deposit in a non-contact fashion very finely controlled dispenser-to-substrate offset distances. These systems can potentially use multiple nozzles; however, they rely on very high pressures to deliver inks with relatively high silver (i.e., >75 weight percentage) loadings and viscosities (>200 cp). The system disclosed herein, by virtue of achieving laminar orifice flow, will have a greater net throughput. Throughput may be further increased if lower viscosity high-loading silver bearing inks are employed.

The printing method described herein has been demonstrated to provide traces of widths that are similar to screen printing and will provide for even narrower widths which will enable increased optoelectronic cell efficiencies. Screen printing itself has not proven in practice to be an effective means to generate very narrow lines (i.e., sub-100 microns). In screen printing it is increasingly difficult to push the ink through the mesh of the screen as the gap in the stencil is reduced. Screen stretch also becomes more of a problem, resulting in greater cost associated with screen waste. The current state of the art for solar cells has a conversion efficiency of about 15%, which is only about half the theoretical maximum in part due to the shadowing effect from the contacts. Efficiencies as high as 22% are realized for solar cell designs that completely eliminate the front side contact grid. Improvements in efficiency of only a fraction of a percent are significant and greatly increase the total power output of the cell over its expected lifetime of 20-30 years. Reducing the width of the collector lines and busbars reduces the shadowed area on the light-collecting side of the cell and improves its overall efficiency.

In one embodiment, the fluid is maintained in the print head assembly 20 at a fixed desired temperature. The continuous stream is a liquid stream at substantially the same temperature. It is well known that the temperature of a liquid greatly affects its flow properties, especially viscosity, so it is generally desirable to control the temperature of the fluid. Operational temperatures as high as 100° C. are preferred for jetting assemblies depending on the volatility and boiling point of the printed fluid. At 40° C., the jetting viscosity would be about 50% lower than that at 25° C.

The throw distance between the orifice and the substrate is typically between 3 and 6 mm, but can be greater than 6 mm due to the inherent momentum of the stream. Throw distance may also be lower than 3 mm if necessary—e.g., to improve placement accuracy. The fluid may pressurized by an external source at 10 psi or greater. The pressures at the orifice might stem from single pressurized source (i.e., a single pump) or from multiple pressurized sources (i.e., one pressurized source per orifice or one per print head.) In FIG. 1, for print head assembly 20, the individual orifices 22 may have discrete pressure sources and/or fluid feed channels. In print head assembly 20, the individual modular print heads 24 may have unique or combined pressure and fluid systems. In the preferred system, printing speed (i.e., differential rate between the deposition rate and the substrate line speed), printing temperature, and delivery pressure will be adjustable to maximize throughput and control line feature size.

Printing with streams is believed to be more reliable in general than printing with standard drop-on-demand (DOD) inkjet devices. The printed streams can be operated intermittently—i.e., controlled by the valves to print onto individual wafers or groups of wafers on-demand. In the preferred embodiment, valves at each orifice would prevent the fluid from drying to the solid form so that jets can be started and stopped reliably. An alternative method to achieve similar startup reliability would be to include as part of the system a print head capping station to prevent drying.

The print head may include any suitable valve-controlled continuous stream print head mechanisms. One embodiment of a suitable print head is shown in FIG. 2 and described in U.S. Pat. No. 7,331,654B2. Similar print heads are commercially available as the Videojet P16 print head or the print head used in the Videojet 1120 microvalvejet printer from Videojet Technologies Incorporated. The valve of FIG. 2 includes a plunger 1 which is journalled as a close free sliding fit for axial reciprocation in a stainless steel tube 2. Tube 2 has a thin insulating coating or sleeve (not shown) formed upon its outer face and supports a coil 3 wound upon it. Coil 3 is supplied with an electric current from a source (not shown) under the control of a computer or other electronic controller (not shown). A stop 4 is mounted at the proximal end of tube 2 to limit the axial retraction of plunger 1 within tube 2. The coil 3 is encased in a metal cylindrical housing 5.

The above print head is mounted in a support housing 10 which extends axially beyond the distal end of the coil 3 and has a transverse end wall 11 which carries a jewel nozzle 12. In the embodiment shown in FIG. 2, housing 10 has an axially extending internal annular wall 13 which forms the radial wall of the valve head chamber 14 into which the distal end of the plunger extends. The distal end of the plunger 1 carries a terminal rubber or other sealing pad 15 which seats against the proximal end face of jewel 12 in sealing engagement. A pre-tensioned conical spring 16 biases plunger 1 into sealing engagement with the face of the jewel as shown in FIG. 2, the rest or valve closed position.

Other kinds of orifices besides the previously described ruby nozzles described are possible, including nozzles formed from monolithic plates including (but not limited to) stainless steel, silicon, polymide, and the like. Other types of ceramics besides rubies are also possible. Orifices may be constructed by all means known in the art including ablation/drilling (EDM, laser, etc.) or by electroforming from a template. Orifices and fluid systems constructed by MEMS fabrication methods well known in the art are also useful for the invention particularly when targeting orifice sizes below about 40 microns. The latter might provide for very smooth finished nozzles which will enable sustainable flow rates through small orifices. Orifices may be cylindrical or tapered. They might also be non-circular—i.e., square and thus have a quadrilateral shape.

Plunger 1 is preferably made from a ferromagnetic alloy having a saturation flux density of 1.6 Tesla such a Permenorm 5000 or similar magnetically soft ferromagnetic alloy. In order to reduce the mass of the plunger 1, it may have a blind internal bore extending from the distal end thereof. It is also desirable that the plunger 1 have a diameter of less than 3 mms, typically about 1 mm, and a length to diameter ratio (l:d) of about 5:1. For example, the bore in the jewel nozzle shown in FIG. 2 has an l:d ratio of between 3.5 and 4.5 and the nozzle orifice has a diameter of between 25 and 100 microns.

Fluid is fed under a pressure to the fluid gallery 17 encompassing wall 13 and enters the valve head chamber via radial ports 18. When the plunger is in its rest position as shown in FIG. 2, the pad 15 is in sealing engagement with the face of the jewel nozzle 12 and thus prevents flow of fluid through the nozzle orifice. In order to enhance the seal between the pad 15 and the jewel 12, the proximal face of the jewel 12 may be provided with one or more raised annular sealing ribs (not shown).

Such a valve can be operated at frequencies of from under 1 kHz to over 8 kHz to produce consistently sized droplets in the size range 20 to 150 micrometers or more by controlling the length for which the current flows in the coil 3 and the frequency at which such current pulses are applied to the coil. The valve may also be operated in a continuous open position to provide a continuous stream of fluid ejected form the orifice 22.

As indicated above, the print head 20 preferably includes an array of multiple orifices 22 extending transversely to the line of travel of a substrate upon which the conductive lines are to be printed. The fluid includes a conductive material that is deposited on the substrate to form a conductive deposit. In one embodiment, the conductive material includes silver particles. The silver particles may be produced in a top down fashion (i.e., physically milled) or by bottom-up approaches such as reduction-precipitation from salt solutions. It may further be provided in nanoparticle form using any of the conventional methods used to produce nanoparticles including thermal sublimation and flame pyrolysis.

The fluid includes a suitable solvent. Solvents that are believed to be suitable include water; alcohols; ketones; esters; ethers; glycol ethers; furans; amines; phthalates; citrates; pyrrolidones; glycols; carbonates; aliphatic or aromatic hydrocarbons; and oils. In one embodiment, the fluid comprises a solvent that is substantially volatile in the range between 25 and 300° C., such as methyl ethyl ketone; acetone; ethanol; isopropanol; methanol; ethyl acetate; isopropyl acetate; n-pentyl proprionate; glycol ethers such as propylene glycol monomethyl ether; ethylene glycol monbutyl ether; diethylene glycol monobutyl ether; propylene glycol monopropyl ether; n-methyl pyrrolidone; glycyol ether acetates such as propylene glycol monomethyl ether acetate; ethylene glycol monbutyl ether acetate; diethylene glycol monobutyl ether acetate; propylene glycol monopropyl ether acetate; or, water. Other solvents than those listed are also possible.

The fluid may include dispersing agents to keep the particles suspended which may be physically bound to the conductive particles. The fluid may also contain surfactants that can limit spreading by interaction with the substrate. The fluid may further include organic binders including but not limited to cellulose derivatives, polyethylene derivatives, and the like. The fluid may have a surface tension between about 22 and 73 dynes per cm at 25° C. using the bubble method.

In order to enable the fluid to work in current applications the fluid may contain any one of the following as components (either as discrete additives, or provided as part of the components listed above): a glass or leaded glass frit (as an adhesion promoter and/or an antireflective layer burnthrough agent); additives that improve solderability; or, dopants that promote contact resistance (i.e., phosphorous containing compounds).

The conductive material composition of the fluid may range between about 10 and 80 weight percentage. The fluid may possess a fluid density from about 1 to about 5 grams per cubic centimeter. The fluid may have a viscosity at jetting temperature of between about 1.5 and 300 centipoises (cp) when measured using a Brookfield viscometer. At room temperature, the fluid may be thick yet pourable (i.e., >300 cp) or substantially solid (i.e., a wax-based hot melt ink) and only reach jetting viscosity in the heated print head. In the case of the latter, the fluid might comprise a semisolid carrier: e.g., a long chain (fatty) alcohol or acid. This range of viscosities is substantially wider than typical inkjet, for example, which has a typical upper viscosity limit of less than 30 cp at jetting temperature.

The substrate to be printed upon is a component of a photovoltaic cell. The substrate generally includes a semiconductor material and may be single crystalline, multicrystalline, amorphous or thin-film based. Thin film based substrates might have been first applied to a primary support web via other solution printing techniques or physical deposition. The substrate may comprise semiconductors from Group IV or combination Group III/V semiconductors. Examples of Group IV semiconductors are silicon and germanium. Examples of Group III/V semiconductors include cadmium/telluride and gallium arsenide. Hybrid versions of these Group III/V substrates are also possible such as InGa/P.

The substrate may be coated with a barrier layer comprising UV/visible light-transparent inorganic material. Common barrier layers are $TiO_2$ or silicon nitride ($Si_xN_y$). Other compositions are possible. In the event that a barrier layer is present at the point of printing, the present printing method allows for the conventional possibility of printing onto the barrier layer followed by the subsequent burn-through to contact with the underlying silicon. This method also allows for other means to form the electrical contact with silicon, for example, by chemical or physical etching of the barrier layer (i.e., ND YAG laser) prior to printing the fluid.

The electrically conductive deposit may be generated after thermally sintering at temperatures high enough to fuse the silver particles into a generally continuous network. In general, sintering temperatures between about 120 and 1000° C. are employed for silver depending on the mean silver particle diameter.

The substrate may be heated or cooled before printing or at the moment of contact printing. The substrate temperature may range anywhere from −70° C. to 200° C. In a preferred embodiment a heated substrate is used to induce evaporation of the volatile solvents on contact with the stream. A 30 to 50% reduction in printed trace is realized when printing on substrates that are preheated on a thermal platen at temperatures up to about 150° C. Heating the substrate in this fashion also would reduce the number of production steps currently employed since the current process calls for a drying step after screen printing. It might also be advantageous to cool the substrate in order to further reduce spreading of the fluid.

Additional processing may be performed on the substrate before or after the fluid is applied. For example, it is known in the art that chemical pretreatment of the substrate can inhibit spreading of the fluid after deposition. In general, surfactants or halogenated polymers can be suitable. Examples of halogenated hydrocarbons include those used as barrier films that can be cast from solvents including fluorinated hydrocarbons or perfluoropolyethers such as those available from 3M Corporation or Nye Lubricants Corporation; and/or PTFE polymers (dispersed or dissolved). Examples of suitable surfactants include dimethicones and polymeric silicones such as those available from Dow Corning Corporation, General Electric Corporation, or Momentive Specialty Products, Corporation.

The collector lines are typically substantially straight and parallel with orthogonally arranged busbar lines. However in the most general case, the conductive contacts may be printed in an arbitrary pattern as desired to increase solar cell efficiency. No limitation is made with regard to the specific pattern that may be printed.

In addition to front side negative electrode contacts, the present method may be practical for printed positive electrode contacts onto the backside of the cell as well. It may also be useful for printing negative electrode contacts on the backside of the cell in the case of cells with no front side contacts.

EXAMPLES

Example 1

Demonstration of Smooth Continuous Line with Microvalvejet Printhead

Non-conductive fluids were printed to demonstrate that the printing method described herein can provide substantially straight lines with good uniformity and linewidths on the order required for the application. A black ink composed of methyl ethyl ketone (MEK) 46.5% (by weight); nitrocellulose solution 50% (by weight) (containing 36% solid nitrocellulose); Valifast black 3808 at 3% (by weight) (in order to perceive color of the printed line) and Silwet L7622 at 0.5% (by weight) was prepared and filtered according to standard methods. The ink was diluted to a viscosity of 5.0 cp at 25° C. The ink was printed using a Videojet P16 microvalve print head which contains sixteen individually addressable values and employs using and external pressurized air source. The continuously flowing ink stream achieved by holding the valves in their open position was directed toward a substrate and deposited thereon by passing the substrate underneath the print head. Substrate speeds were approximately controlled to about 1500 mm/second. Using a 45 micron orifice plate and controller pressure at 30 psi, glass substrates were printed, yielding microscopically measured linewidths as narrow as about 200 microns. The edge acuity of the lines was very good and under 8× or better magnification—as good or better than commercial photovoltaic cell screen printed samples.

Example 2

Figure 4:
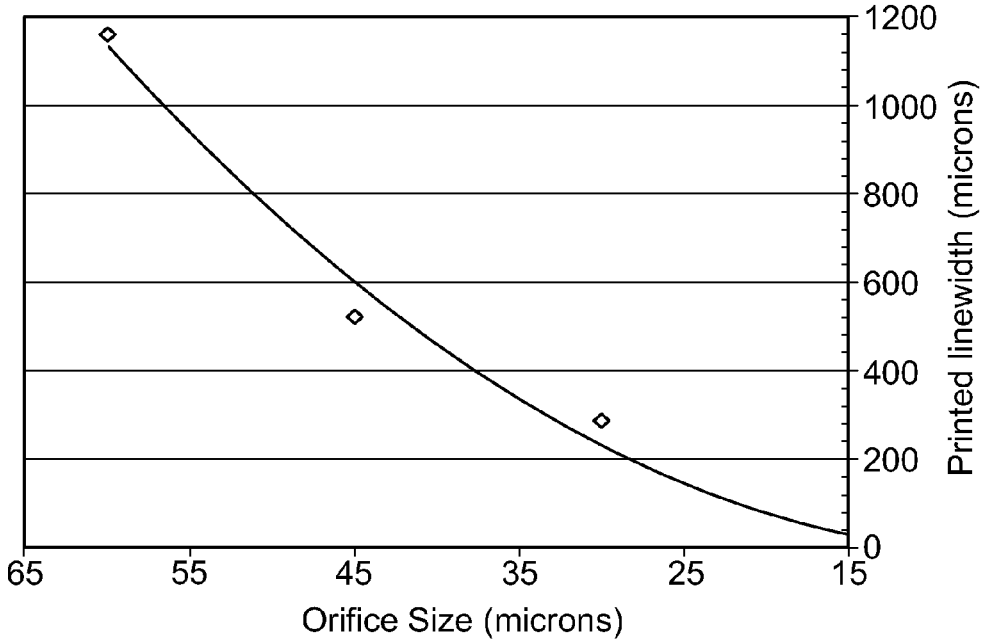
FIG. 4 is a graph showing printed linewidth as a function of the orifice size, as described in Example 2.

Demonstration of Spreading Factors at Different Orifice Sizes for Microvalvejet Printhead The non-conductive ink described in Example 1 was printed onto a rough ceramic substrate. Using the Videojet P16 print head, nozzle plates with orifice sizes of 60 and 45 microns were used and the pressure was controlled at just above the lowest value required to achieve good laminar flow (10 to 30 psi). In addition, a print head from a Videojet 1120 microvalvejet printer was used with an orifice size of 30 microns. In this case the same ink from Example 1 was used but diluted with solvent to 3.7 cp at 25° C. These experiments demonstrated that different orifice sizes yielded lines of different widths when printed onto substrates at room temperature. FIG. 4 shows the line width as a function of orifice size. If one considers the ratio of the printed line to the orifice diameter to be the spreading factor, one can see a factor of about 4 to 5 is normal for the orifice lower limit (30 microns) in this case.

Example 3

Minimum Flow Rate Determinations

Single nozzles used conventionally in Videojet single nozzle continuous inkjet (CIJ) printers were adapted for use here to determine flow rate limitations versus orifice size for printed streams. A pressurized source was used as described in Example 1; however. in the case of the CIJ nozzles, a single mechanical valve located behind the nozzle in the direction of flow was used to control flow to the nozzle. Fluid pressures were maintained at 40 psi. In a typical measurement, the flow rate was assessed by gathering the ink in a pan for one minute and weighing the pan to determine the mass of ink accumulated. This mass was converted to volume using the density of the fluid. Orifices with diameters of 36, 53 and 80 microns, each with aspect ratios near 1, were used. Different fluids were used to test a range of viscosities including a number of pure solvents (i.e., MEK, ethylene glycol, etc.) as shown in Table 1 below.

| Solvent | Viscosity Cp | Density g/cc |
|---|---|---|
| MEK | 0.4 | 0.8 |
| nMP | 1.7 | 1.03 |
| diacetone alcohol | 3.1 | 0.93 |
| tributyl phosphate | 3.4 | 0.98 |
| 1-heptanol | 5.6 | 0.82 |
| Glycol ether TPM | 6.1 | 0.96 |
| Magisol 60 | 8.8 | 0.83 |
| ethylene glycol | 17.1 | 1.11 |
| tributyl citrate | 25 | 1.04 |
| butylbenzyl phthalate | 39.5 | 1.12 |

Figure 5:
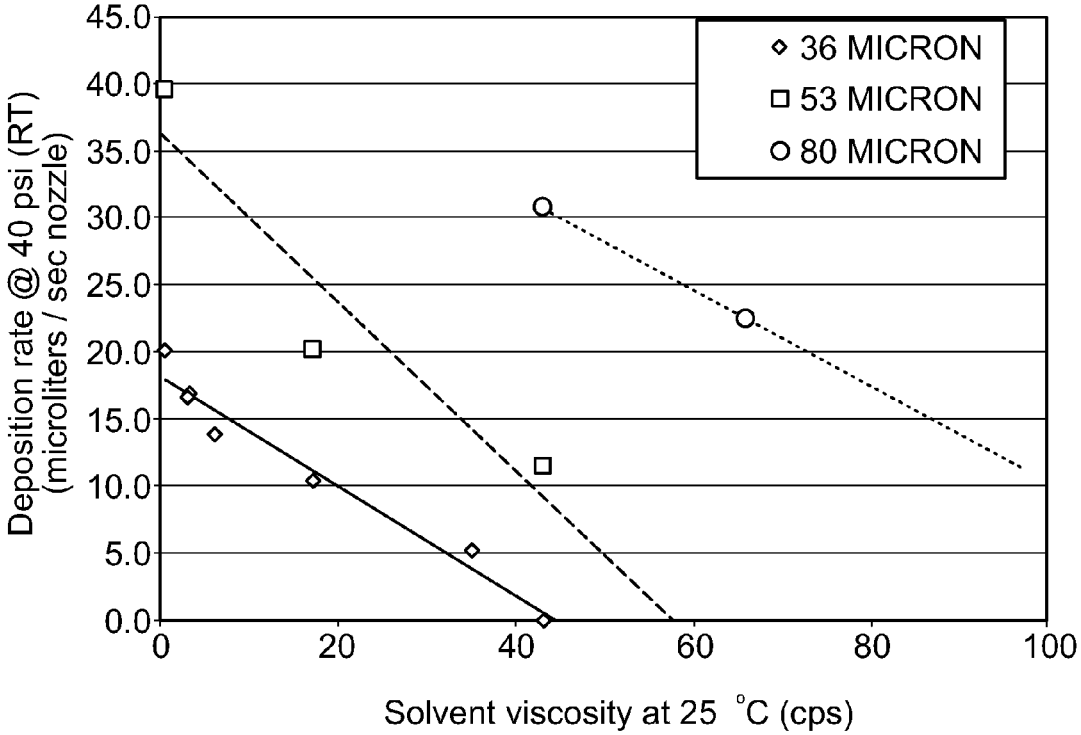
FIG. 5 is a graph showing the deposition rate as a function of solvent viscosity for different orifice sizes, as described in Example 3.
Figure 6:
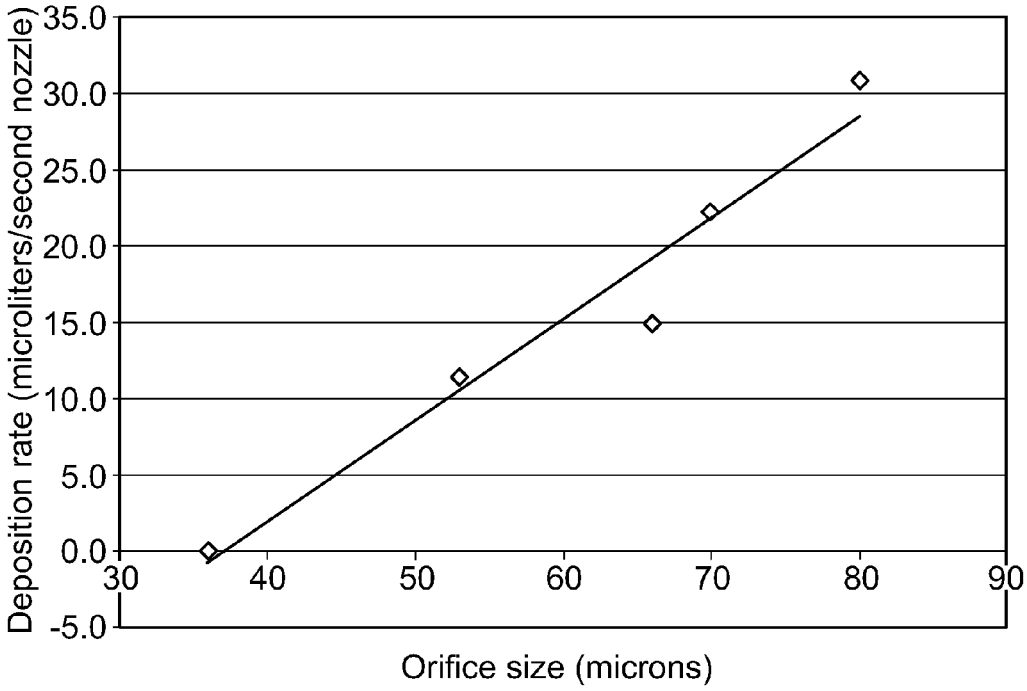
FIG. 6 is a graph showing deposition rate as a function of orifice size for a single viscosity, as described in Example 3.

FIG. 5 shows the observed deposition rate as a function of solvent viscosity for various nozzle sizes. For a 36 micron orifice, jettable stream viscosity limits above 30 cps at about 25° C. are possible. For an 80 micron nozzle, stream viscosities in excess of 100 cps at 25° C. are possible. Plasticizer 160 (butyl benzyl phthalate) that has a viscosity of 43 cp at 25° C. was further tested using CIJ nozzles with orifice sizes of 36, 53, 66, 70 and 80 microns to validate the trends observed. The resulting flow variation with nozzle size is provided in FIG. 6 showing that a wide range of flow rates are achievable based on orifice size variation. Hence, based on these results combined with the results from Example 2 above, this method is capable of printing lines at about 200 microns with the required single pass throughput (>5 mg/s) without any special process modifications to reduce linewidths.

Example 4

Demonstration of Printing Fine Lines

Figure 7:
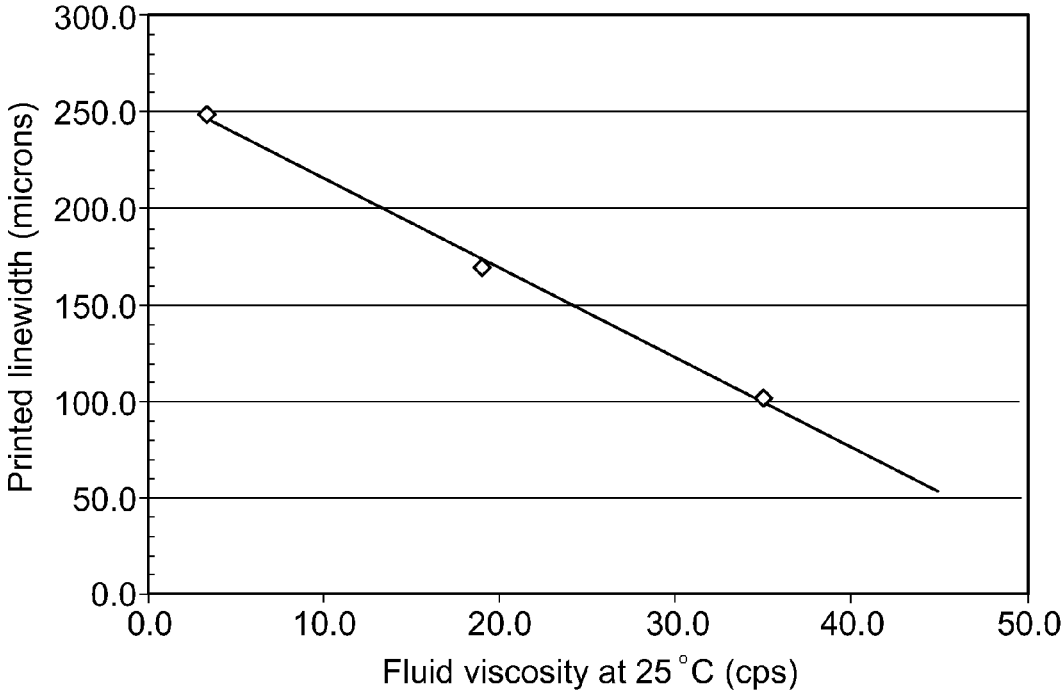
FIG. 7 is a graph showing printed linewidth as a function of fluid viscosity, as described in Example 4.

A black ink composed of methyl ethyl ketone (MEK)<50% (by weight); nitrocellulose solution>50% (by weight) (with 36% solid nitrocellulose); Valifast black 3808 at around 3% (by weight) and Silwet L7622 at around 0.5% (by weight) was prepared according to standard methods. The ink viscosity was measured at 19 cp at 25° C. A concentrated version of this ink was also prepared (with more nitrocellulose) at 35 cp at 25° C. These two inks along with the ink from Example 2 at 3.7 cp at 25° C. were printed with continuous streams from a Videojet 36 micron nozzle onto a rough ceramic substrate using the same printing setup as described in Example 3. Samples were printed as before on substrates both at room temperature (ca. 25° C.) and ones preheated to 150° C. Heating reduced the linewidth by about 30 to 50% over unheated examples. For example, the resulting width was reduced from about 150 to about 100 microns for the 35 cp ink. The resulting linewidths for the preheated substrates for different viscosities are given in FIG. 7. This data supports that linewidths well below 100 microns are possible using these volatile inks by increasing the jetted ink viscosity. The same 35 cp ink was also printed onto a polycrystalline photovoltaic cell preheated to about 60° C. This yielded printed lines that were about 120 microns in width.

Example 5

Demonstration of Printing a Conductive Ink

A commercial silver inkjet fluid from Cabot, Inc. (CCI-300) was printed using the same printer setup as in Example 3. CCI-300 exhibited a viscosity of about 13 cps at 22° C.; a silver loading of about 20% by mass with a mean particle size of about 50 nm. The primary solvent was a volatile alcohol. The fluid was printed in a single pass at 40 psi from a 36 micron Videojet nozzle onto a photovoltaic cell pretreated by brush-application of FC-722, a chemical once available from 3M Corporation. The resulting line was cured at 180° C. for approximately 20 minutes. The line was measured at about 210 microns wide. The sheet resistance of the printed line was measured with an ohmmeter at about 400 milliohms per square cm. The difference in printed width in this case is believed to be due to the nature of the fluid being of lower inherent surface tension than the MEK based test inks used in previous examples.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A printing method comprising:

providing a print head, the print head comprising a valve and at least one orifice;

ejecting a fluid from the orifice in a generally continuous stream, wherein the fluid stream has a deposition rate of at least 1.5 mg/s, where the fluid comprises silver, and wherein the orifice of the print head has a diameter of less than or equal to 25 microns; and depositing the fluid in a pattern on a substrate to form an electrically conductive deposit, wherein at least a portion of the pattern includes a generally straight line, and wherein the line has a width of less than 200 micron and a minimum height of at least 3 microns.

2. The printing method of claim 1 wherein the fluid has a viscosity of between 2 and 300 cp using a viscometer at jetting temperature.

3. The printing method of claim 1 wherein the fluid is pressurized externally at 10 psi or greater.

4. The printing method of claim 1 wherein the valve is switchable between the stream-on and stream-off state.

5. The printing method of claim 1 wherein the orifice has an aspect ratio between 0.5:1 and 8:1.

6. The printing method of claim 1 wherein the fluid comprises a solvent that is substantially volatile in the range between 25° C. and 300° C.

7. The printing method of claim 1 wherein the electrically conductive deposit in claim 1 is generated after thermally sintering.

8. The printing method of claim 1 wherein the substrate comprises silicon.

9. The printing method of claim 8 wherein the silicon is coated with a barrier layer comprising $TiO_2$ or silicon nitride ($Si_xN_y$).

10. The printing method of claim 1 wherein the line has a sheet resistance maximum value of less than 10 mOhms per square cm.

11. The printing method of claim 1 wherein the print head comprises a plurality of orifices, wherein the pitch distance between adjacent orifices is less than or equal to 10 mm.

12. The printing method of claim 1 wherein the print head comprises a ruby nozzle.

13. A method for depositing a conductive material on a substrate, comprising:

providing a print head assembly, the print head assembly comprising a plurality of individually-addressable modular print heads, wherein each modular print head comprises an orifice, wherein the orifice has a diameter of less than 40 micron;

ejecting a fluid from the orifices in a generally continuous stream, where the fluid comprises a conductive material comprising silver;

depositing the fluid in a pattern on a semiconductor substrate to form an electrically conductive deposit, wherein the fluid stream has a deposition rate of at least 1.5 mg/s, wherein at least a portion of the pattern includes a plurality of generally parallel straight lines, wherein the line has a width of less than 200 micron and a minimum height of at least 3 microns.

14. The printing method of claim 13 wherein the spacing between the lines is less than 10 mm.

15. The printing method of claim 13 wherein each of the orifices in the print head is controlled by an individually addressable valve, wherein the pitch distance between adjacent orifices is less than or equal to 10 mm.

16. The printing method of claim 13 wherein the orifice of the print head has a diameter of less than or equal to 36 microns.

17. The printing method of claim 13 wherein the print head comprises a ruby nozzle.

* * * * *